US012729604B2

(12) United States Patent
Enriquez et al.

(10) Patent No.: US 12,729,604 B2
(45) Date of Patent: Sep. 8, 2026

(54) APPARATUS, SYSTEM, AND PROCESS FOR REMOTE WELL CONTROL

(71) Applicant: Sentry Frac Services, LLC, The Woodlands, TX (US)

(72) Inventors: Jimmy Enriquez, The Woodlands, TX (US); Scottie Ross, The Woodlands, TX (US)

(73) Assignee: SENTRY FRAC SERVICES, LLC, The Woodlands, TX (US)

( * ) Notice: Subject to any disclaimer, the term of this patent is extended or adjusted under 35 U.S.C. 154(b) by 0 days.

(21) Appl. No.: 19/359,461

(22) Filed: Oct. 15, 2025

(65) Prior Publication Data

US 2026/0103956 A1 Apr. 16, 2026

Related U.S. Application Data

(60) Provisional application No. 63/707,499, filed on Oct. 15, 2024.

(51) Int. Cl.
*E21B 34/16* (2006.01)
*E21B 43/26* (2006.01)

(52) U.S. Cl.
CPC ..... *E21B 34/16* (2013.01); *E21B 43/2607* (2020.05)

(58) Field of Classification Search
CPC ..... E21B 34/16; E21B 43/2607
See application file for complete search history.

(56) References Cited

U.S. PATENT DOCUMENTS

| | | | | |
|---|---|---|---|---|
| 11,137,109 | B2 * | 10/2021 | Babineaux | F16N 11/08 |
| 2013/0233560 | A1 * | 9/2013 | Davidson | E21B 43/2607 166/308.1 |
| 2018/0283138 | A1 * | 10/2018 | Peyregne | E21B 34/16 |
| 2023/0094201 | A1 * | 3/2023 | Williams | E21B 41/00 340/853.1 |
| 2023/0287760 | A1 * | 9/2023 | Kabrich | E21B 34/025 |
| 2023/0287768 | A1 * | 9/2023 | Kabrich | E21B 43/12 |
| 2023/0287776 | A1 * | 9/2023 | Kabrich | E21B 43/26 |
| 2024/0240549 | A1 * | 7/2024 | Curry | E21B 43/26 |

* cited by examiner

*Primary Examiner* — Shane Bomar
(74) *Attorney, Agent, or Firm* — Brandon Cook; Gunn, Lee & Cave, P.C.

(57) ABSTRACT

An apparatus, system, and method for the simultaneous remote control and monitoring of multiple wells. A main housing houses a plurality of hydraulic controls sets, each set of hydraulic controls corresponding to the fluid control valves of a well being controlled by the system. The controls are controlled by a programmable logic controller via solenoids. A control station housing houses a control station with separate touch screens for each well being controlled. The user can open and close the fluid control valves of each well using the corresponding touch screen. The touch screen also displays data for each well that is collected by a series of sensors throughout the well. The system can be pre-programmed with pre-approved valve sequences and/or safety alerts that are triggered based on the data collected by the sensors.

10 Claims, 10 Drawing Sheets

APPARATUS, SYSTEM, AND PROCESS FOR REMOTE WELL CONTROL

CROSS-REFERENCES TO RELATED APPLICATIONS

This application claims the benefit of the filing date of provisional patent application Nos. 63/707,499 filed Oct. 15, 2024 and 63/775,452 filed Mar. 21, 2025.

STATEMENT REGARDING FEDERALLY SPONSORED RESEARCH OR DEVELOPMENT

Not applicable.

BACKGROUND OF THE INVENTION

Hydraulic fracturing for oil and gas reserves was invented in 1862, but commercial exploitation did not begin until the 1940s. The past decades have proven to favor hydraulic fracturing enabling oil and gas producers to extract hydrocarbon reserves from shale rock and other tight formations. Typically, a fracking operation includes a frac manifold (also referred as a frac tree, frac stack, or a Christmas tree). During a fracking operation, the frac manifold is placed at the top of the wellhead. A frac manifold typically consists of a plurality of fluid control valves, such as gate valves.

Extremely high pressures are required for a frac operation, forming what is referred to as the "red zone" around the high pressure well head. It is beneficial for operators to reduce the number of personnel that must be in the red zone and to minimize the amount of time personnel must spend in the red zone.

It is also beneficial for operators to be able to access real-time on-premises data about what is happening inside the well. The ability to receive and review accurate real-time data remotely is desirable.

Various devices and methods exist that purport to provide or enhance the ability to remotely operate a well. However, there remains a need for more efficient methods for remote well control and improved methods of collecting and presentation of data during fracing operations.

BRIEF SUMMARY OF THE INVENTION

The present invention comprises an remote well control system with automated and manual controls for completion of a frac operation on multiple wells at one time. The system comprises pressure transducers (and other types of data measuring devices) and a programable logic controller ("PLC") configured to make decisions and/or adjustments concerning frac operations based on data collected. More specifically, the system can remotely and autonomously open and close valves and perform other completion operations based on data captured by the system.

The system further comprises control station wherein an operator can manually control the system based on real-time on-premises data provided by the system. The system may further comprise a remote component wherein an operator can remotely control the system based on a real-time data feed from the system.

The system comprises a control unit, a main housing, controls, regulators, solenoid valves, pressure transducers, hydraulic accumulator tanks, a diesel hydraulic pump and an electric hydraulic pump. Those skilled in the art understand additional components may be necessary for the implementation of the present invention such as various valves, hoses, and other equipment and infrastructure commonly used in frac operations.

The controls are intended to control actuation of components within the fracking operation, such as fluid control valves. The system further comprises sensors and measuring devices to provide the operator with information about the status of the operation. The system comprises safety protocols wherein certain functionality will not function when a proper sequence of events is not performed, when certain criteria are detected such as an open/closed valve, or measurement of one or more measurables is over or under a certain threshold. The system prevents the well from being open to atmosphere without a company man's authorization. The authorization may be either in the form of a pin number, radio frequency identification ("RFID") card, or other means of providing verification.

The system collects, monitors, and transmits real time on-premises data and analytics regarding the operation. The data is accessible to operators via control screens or remotely via a computer device(s).

The control unit of the system comprises a screen display. The screen display is capable of displaying real-time on-premises data captured from the operation in a screen readable format. The captured data can include fracking data such as pressures, time stamps, temperatures, and other data. The captured data can also include flowback data such as barrel rate. Ideally, the control unit comprises multiple touch screens wherein each touch screen corresponds to a different well of a multi-well operation. Thus, providing a dedicated screen for each well allowing the operator(s) to simultaneously monitor and operate multiple wells without the hassle of flipping between screens. Operators can remain logged in and in full control, streamlining field management. The system can recognize and store multiple accounts and account types. Different levels of control can be given to different accounts. The control unit screens can be used to control the controls of the system, thereby controlling the fluid control valves on the frac units.

The system allows for one or more wells to be isolated so that if a problem arises wherein operation of one well must be shut down, operation of the other wells may continue. More specifically, in the event of a localized issue, the system can isolate an individual well while allowing operations to continue on the wells unaffected by the localized issue.

The system further comprises a wireline detecting implement and an automated flowback monitor. The combination of the flowback monitor, valve position sensors, and transducers to read flow for sequencing is a novel concept not disclosed in the prior art. The system described herein improves the efficiency of a frac operation and improves safety by minimizing the need for people to be close to high pressure areas, also referred to as the red zone. The system also increases safety by providing automated lockouts and/or alerts based on the detection of pre-set criteria.

Schematics and detailed descriptions of embodiments an apparatus, system, and process for remote well control are included herewith. Those skilled in the art understand that the system may need to be altered to meet the needs of a particular well (or series of wells). Those skilled in the art further understand that the concepts disclosed herein could be used to measure and record other types of data and/or perform other functions on the wellsite.

DETAILED DESCRIPTION OF THE INVENTION

Figure 1:
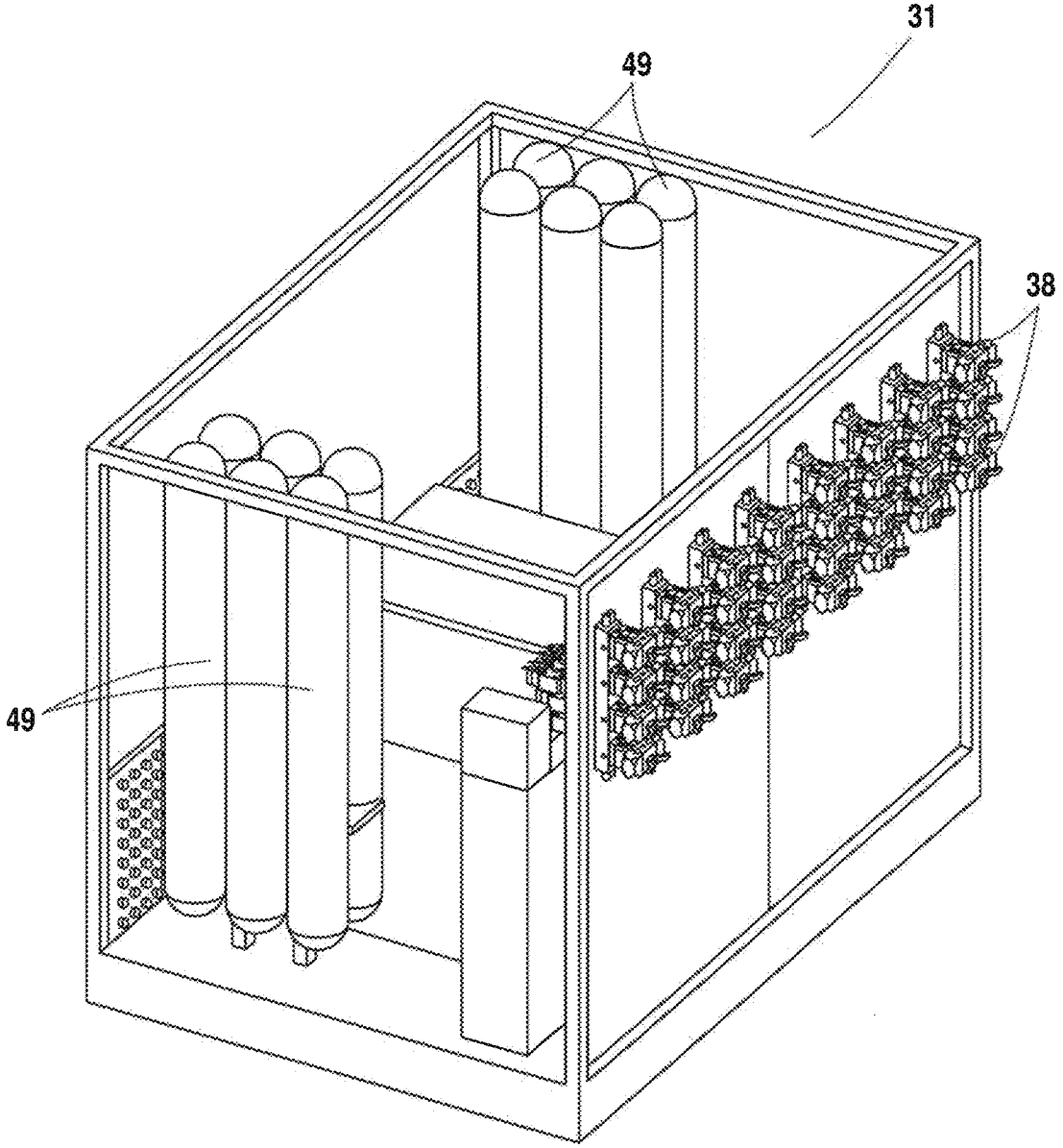
FIG. 1 is a perspective cut-away view of an embodiment of a main housing of the present invention.
Figure 2:
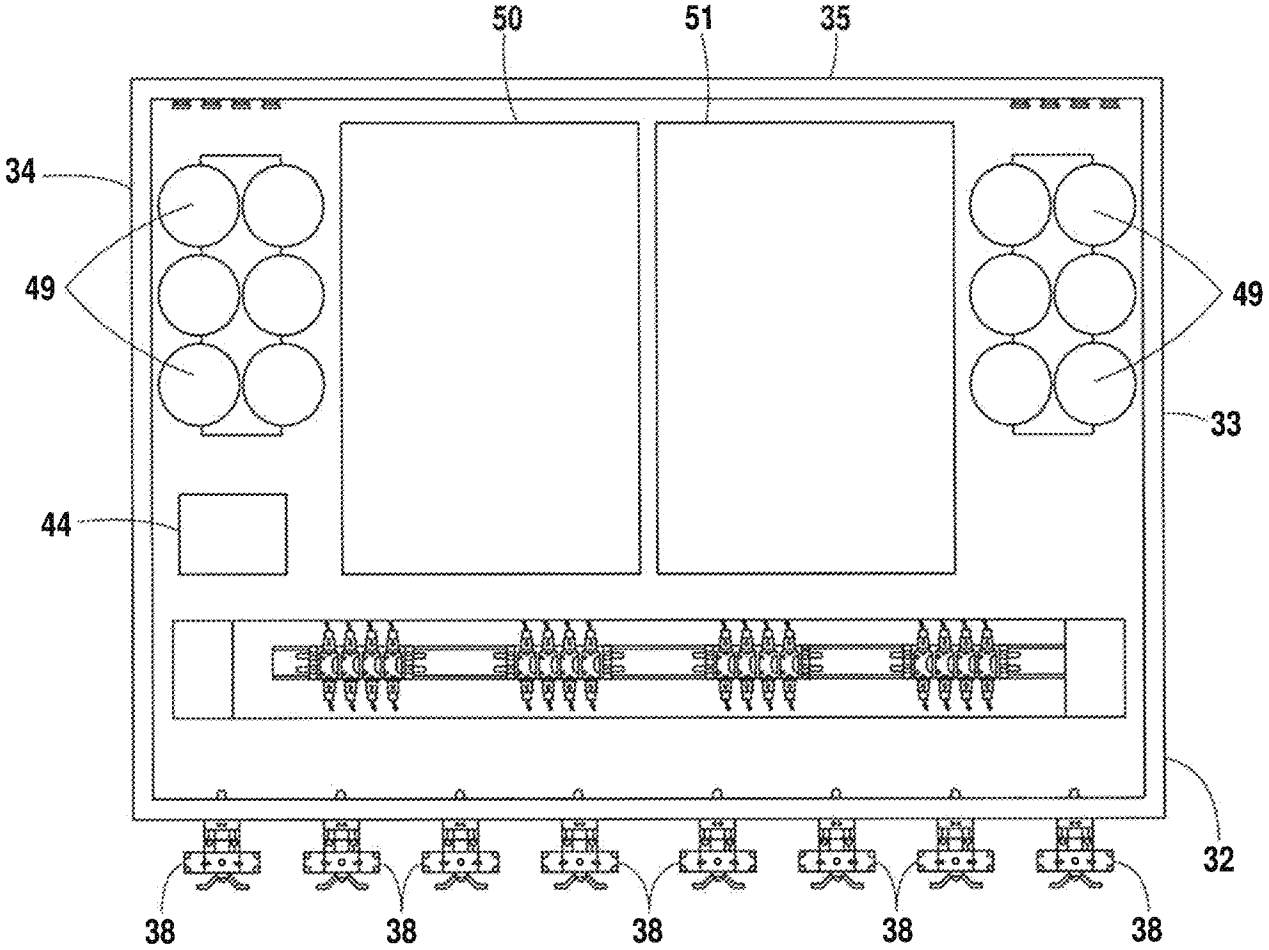
FIG. 2 is a top cut-away view of an embodiment of the main housing of the present invention.
Figure 3:
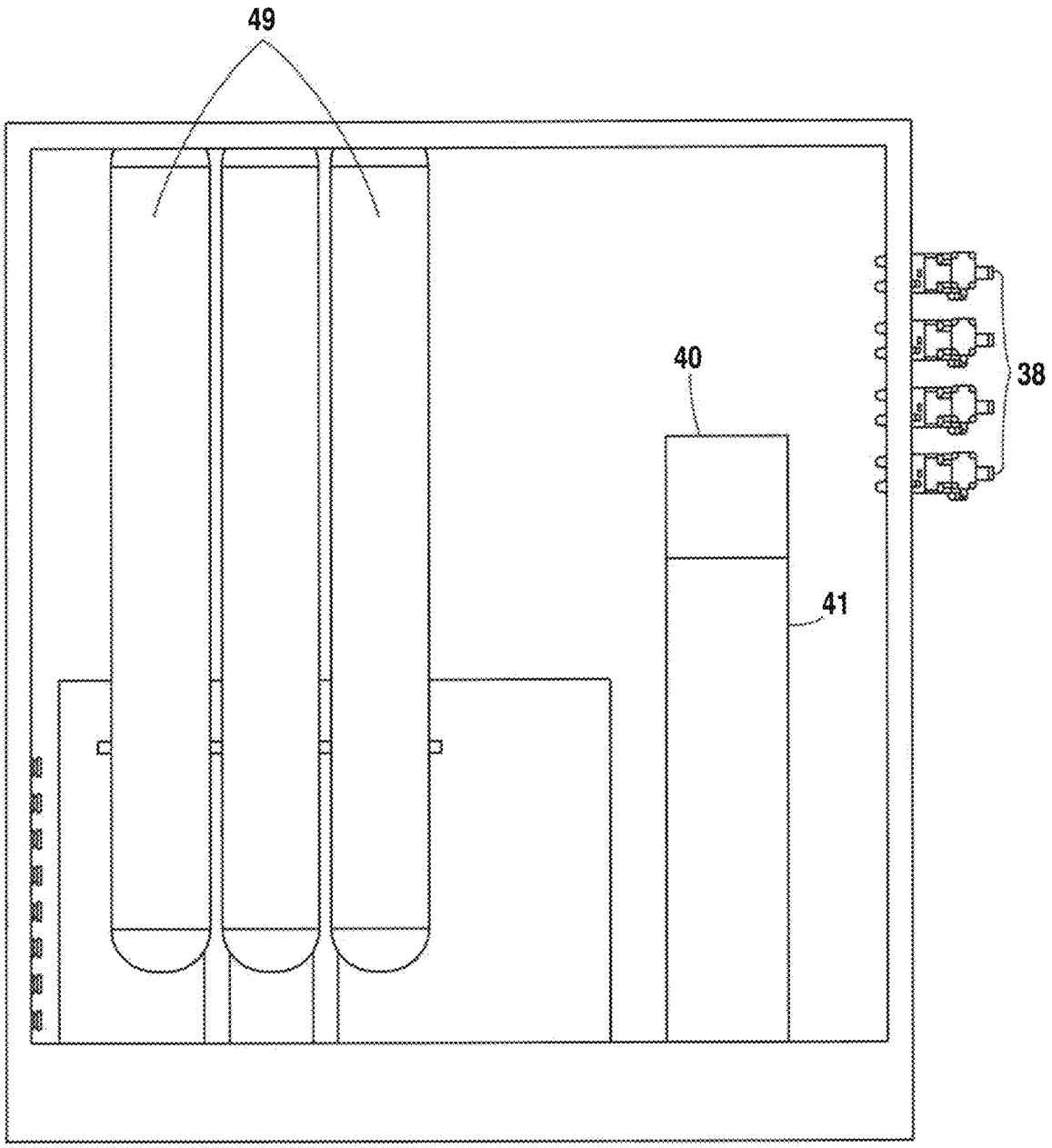
FIG. 3 is a side cut-away view of an embodiment of the main housing of the present invention.

A first embodiment of an automated well control system 30 is described with reference to FIGS. 1-10. With reference to FIGS. 1-4 and 6, the first embodiment 30 described herein is described with reference to having four well controls. Those skilled in the art understand the invention(s) described herein could be used to control more or less wells. Those skilled in the art understand that the automated control unit described herein is intended to be used in conjunction with a frac operation. Those skilled in the art understand the components, devices, and methods typically used in frac operations without the need to recite all such components, devices, and methods herein.

The automated well control system 30 comprises a main housing 31. The main housing 31 comprises a front panel 32, a first side panel 33, a second side panel 34, a back panel 35, a top panel 36, and a bottom panel 37. In other embodiments, the main housing 31 can have one or more of the panels replaced with a partial panel and/or an opening.

A plurality of automated hydraulic controls 38 are mounted to the front panel 32 of the main housing 31. Controls such as ½" national pipe tapered controls are suitable. Hydraulic actuator wing handles protrude from the front panel 31. In other embodiments, the controls 38 can be push button controls, switches, digital controls, or a combination.

For a four well control system, there are thirty-two controls 38 arranged in eight columns of four controls. The controls 38 are further divided into four pairs of two columns. Each pair of controls 38 corresponds to a well that is being controlled by the system. In each pair, one column of controls 38 controls the well side components and operation for that well. The other column controls the zipper manifold. Persons or ordinary skill in the art understand that each control 38 may not be necessary for the control of a particular well or series of wells.

A hydraulic power unit (HPU) reservoir 41 is inside the main housing 31 proximate the interior of the front panel 32. A control valve manifold 40 is mounted on the HPU reservoir 41. A control valve manifold such as a model no: IM50-H4N3SCZWDZ rev 1 is suitable.

Figure 7:
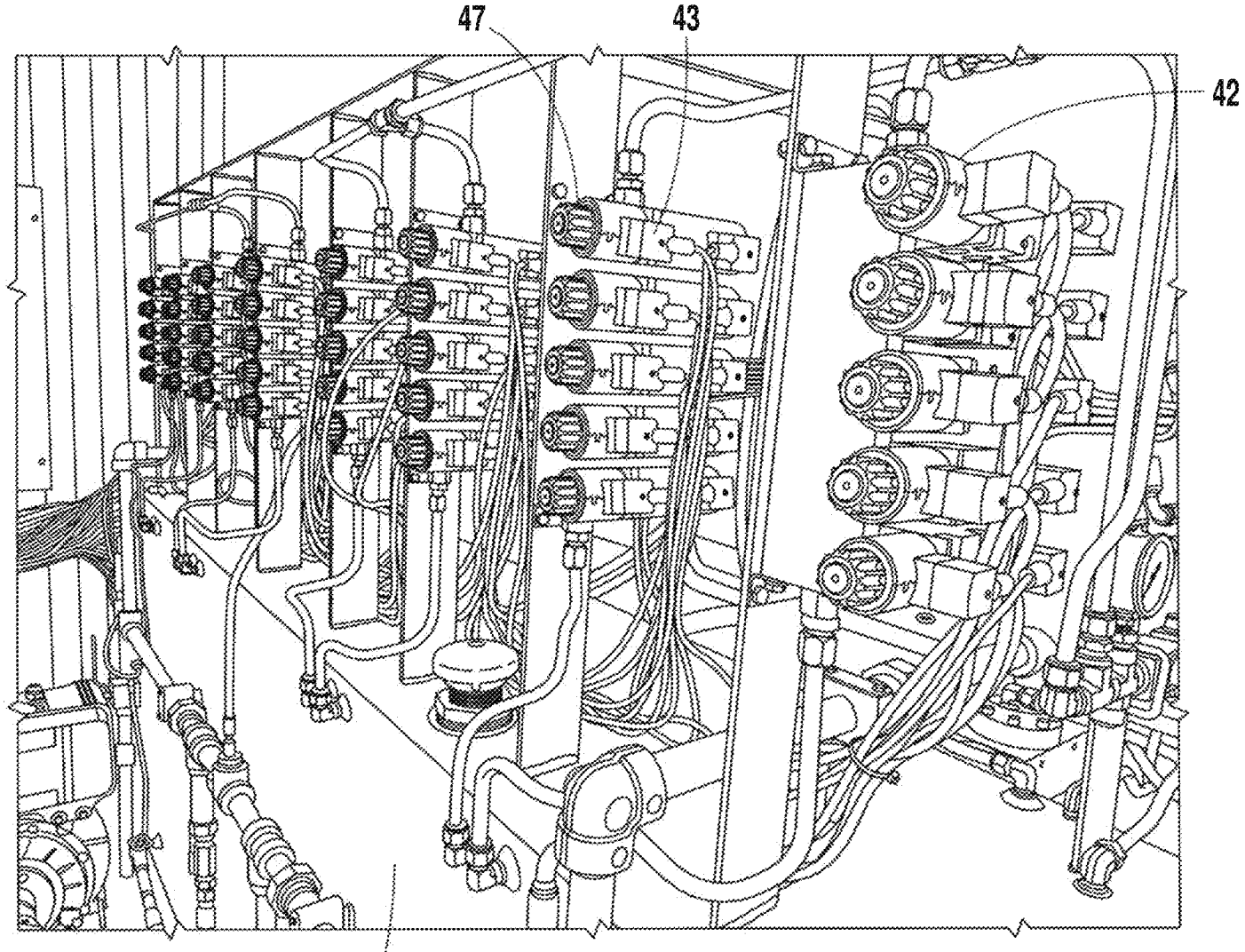
FIG. 7 is a partial interior view of an embodiment of a main housing of the present invention.
Figure 8:
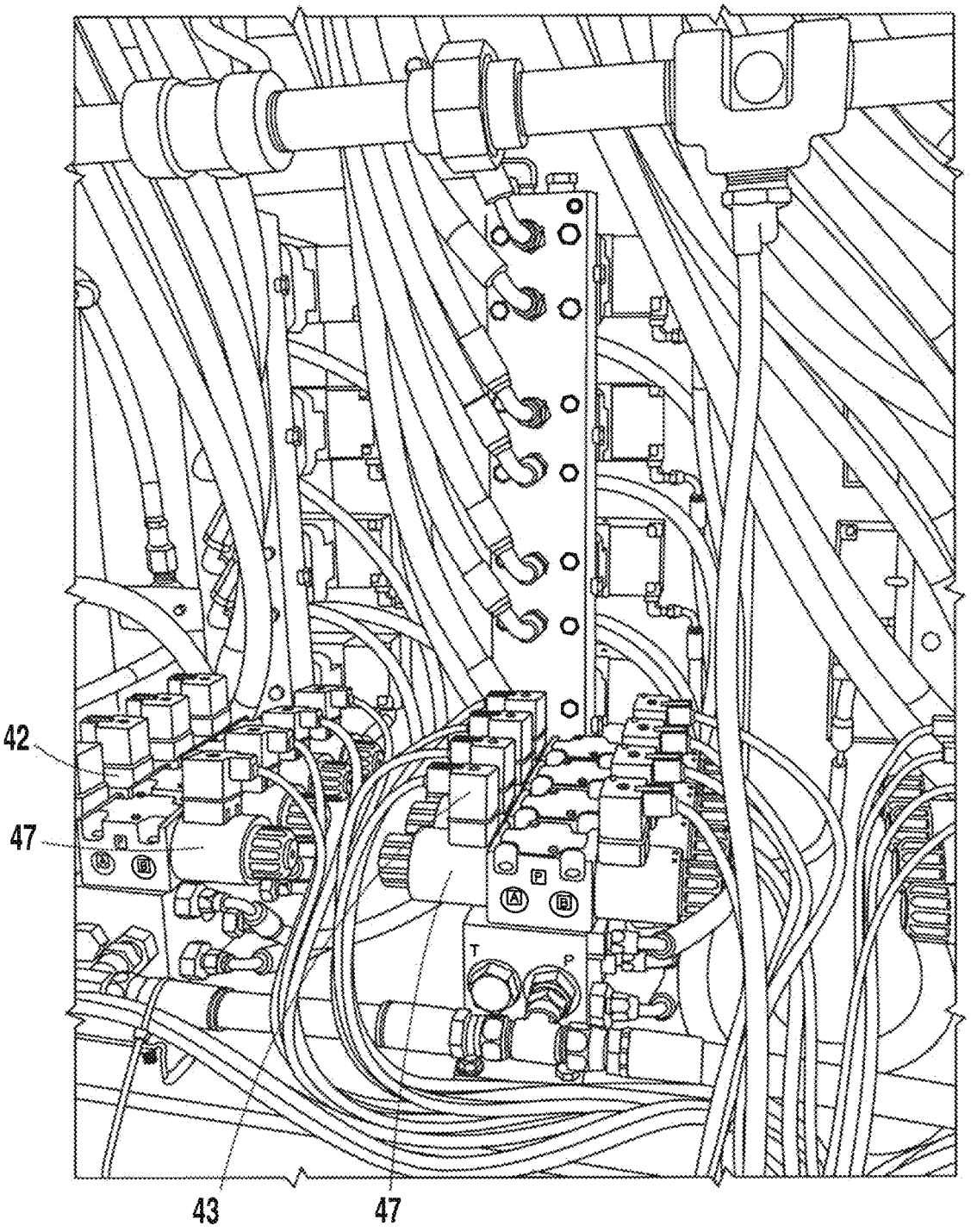
FIG. 8 is a partial interior view of an embodiment of a main housing of the present invention.

With reference to FIGS. 8-7, a solenoid valve assembly 42 is mounted to the HPU reservoir 41 proximate the control valve manifold 40. A solenoid valve assembly such as a model no. PHI-Ds3X4M24-X rev 2 is suitable. The solenoid valve assembly 42 is mounted on top of the HPU reservoir 41 and plumbed with high pressure hoses and connectors to absorb vibration during transportation and/or operation of the system. The solenoid assembly 42 comprises a plurality of solenoids 47.

DIN switches 43 may be connected into a junction box 45. The junction box 45 may be connected to a control box 46. The DIN switches 43 open and close the solenoids 47 pursuant to instructions from the programable logic controller 44. DIN switches 43 operate by sending a signal or sending no signal. The DIN switches plug into the solenoids 47 on one end. The DIN switches are connected via a wire on the other end to the PLC 44 and in electronic communication with the PLC 44. There is a DIN switch 43 for each solenoid 47. There is a solenoid 47 for each control 38.

A solenoid 47 causes the corresponding control 38 to activate when a signal is sent by the DIN switch 43 to the solenoid 47. The user causes the PLC to send the signal to the DIN switch 43 via a user interface. When a control is activated 38, the control opens or closes a corresponding fluid control valve 48 via hydraulic communication.

A plurality of hydraulic accumulator tanks 49 are contained within the main housing 31. In the embodiment shown in then figures, twelve eleven-gallon hydraulic accumulator tanks 49 are arranged in two groups of six.

The system 30 has an electric engine 50 and a diesel engine 51. The primary engine is the electric motor 50. The diesel engine 51 is a secondary engine. Both the electric engine 50 and the diesel engine 51 are plumbed and ready for use so that the diesel engine 51 is always ready for immediate use if there is a problem with the electric motor 50.

The PLC 44 may be located in the main housing 31.

Preferably, the HPU reservoir tank 41 is a large reserve tank, such as a two-hundred gallon tank. The large tank size ensures the ability to place and operate the system 30 over 150-250 feet from the redzone. A two-hundred gallon tank ensures operational flexibility providing for a reach of up to 250 feet from the furthest well. The large tank allows the system 20 to support large field layouts.

Threaded hoses 52 may connect the controls 38 to a subpanel 53. The subpanel 53 may be labeled to facilitate correct hose delegation (labels to make sure the hoses are connecting to the correct valves).

The system 30 may include a 480 or 240v connection for an electrical pump to provide for optimized industrial power.

Persons of ordinary skill in the art understand that additional components such as gauges, valves, hoses, switches, and computing systems may be implemented in the system 30.

Ideally, the main housing 31 panels are aluminum to prevent weather from damaging the components housed within the main housing 31.

In the embodiments shown herein, all aspects of the system 30 are consistent with American Petroleum Institute (API) Specification 6A standards, which is a feature not found in prior art well control systems.

Figure 4:
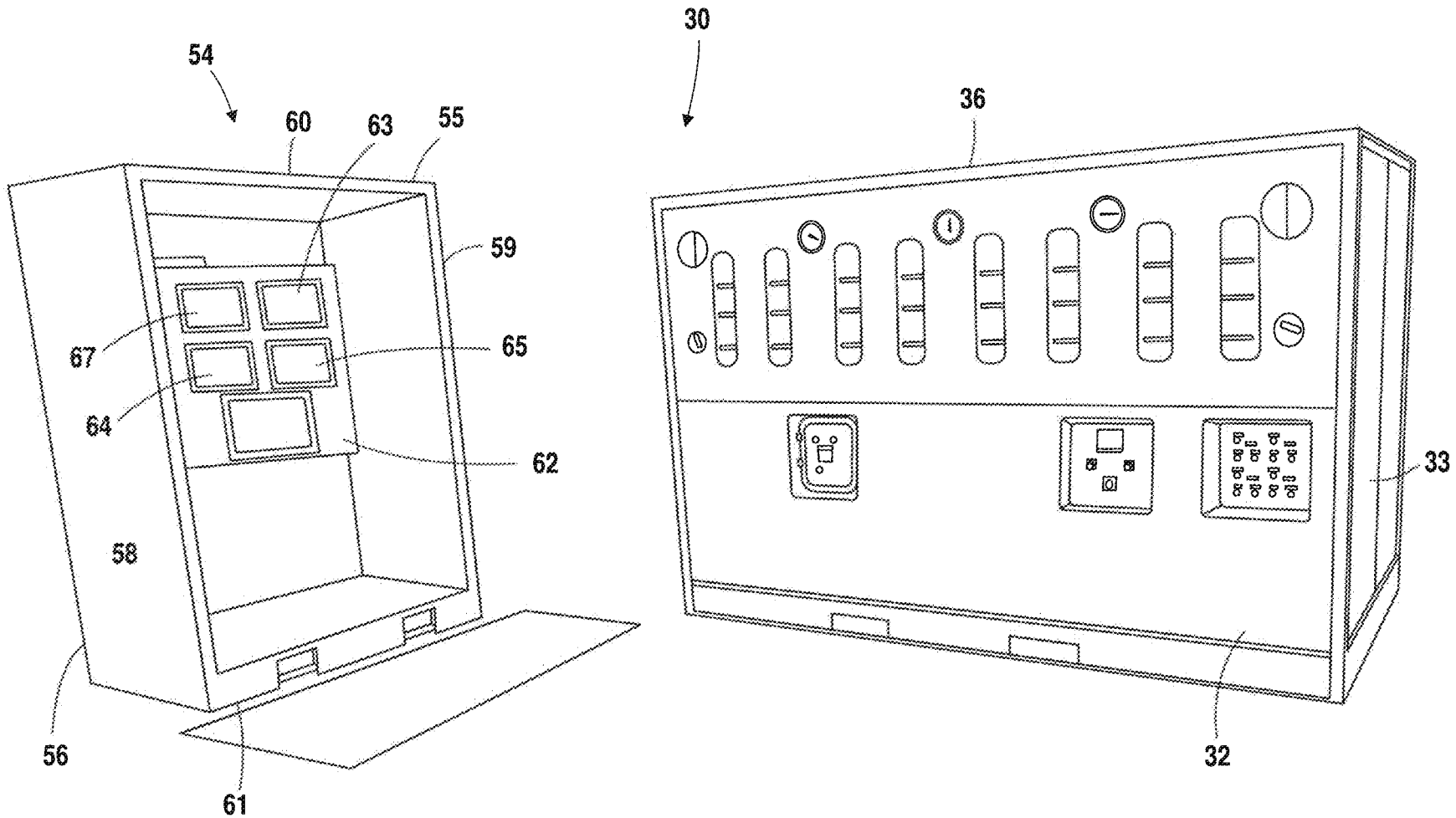
FIG. 4 is a perspective view of an embodiment of a main housing and control station of the present invention.

Referring to FIG. 4, the system 30 further comprises a control station, or control unit 54. The control station 54 may be housed within a control station housing 55 comprising a back panel 56, first side panel 58, a second side panel 59, a top panel 60, a bottom panel 61, and a removal front panel or door 62. The control station housing 55 is ideally made of a sturdy material such as metal and protects the control station 54 from weather damage and/or environmental interruptions. Ideally, the control station 54 is in a sperate housing 55 than the main housing 31. Ideally, the control station 54 and control station housing 55 are positioned a safe distance from the frac operations. In FIG. 4, the control station 54 is shown in close proximity to the main housing 31. This is just for demonstration purposes. In practice, the control station 54 is placed outside the redzone for the wells being controlled, which allows for the operator(s) to control the well from a safe distance.

Ideally, the control station 54 is in electronic communication with the PLC 44 in the main housing 31. Alternatively, the control station 54 could be in direct electronic and/or hydraulic compunction with the controls 38.

Figure 5:
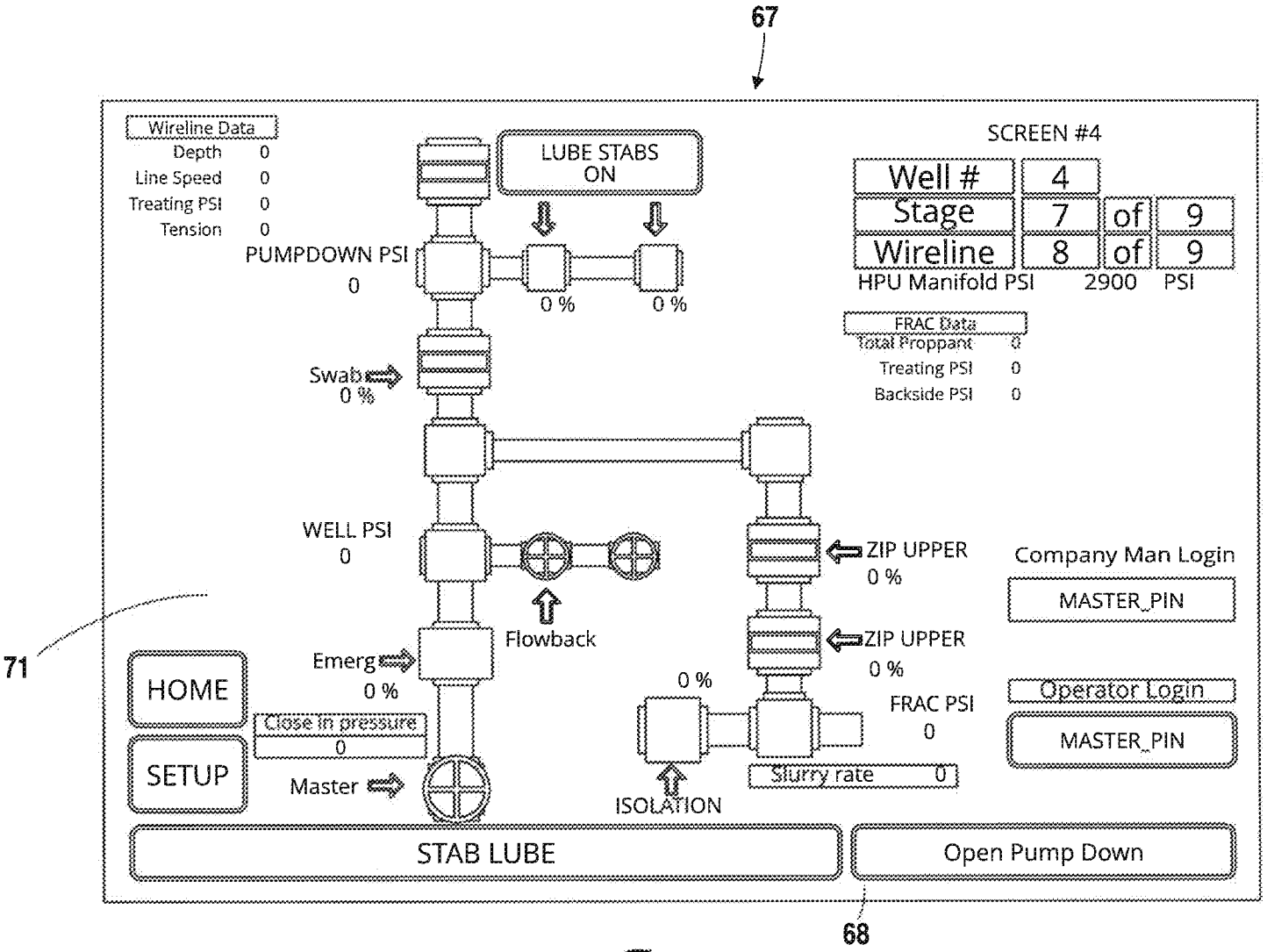
FIG. 5 is a front view of a touch screen of the present invention.
Figure 6:
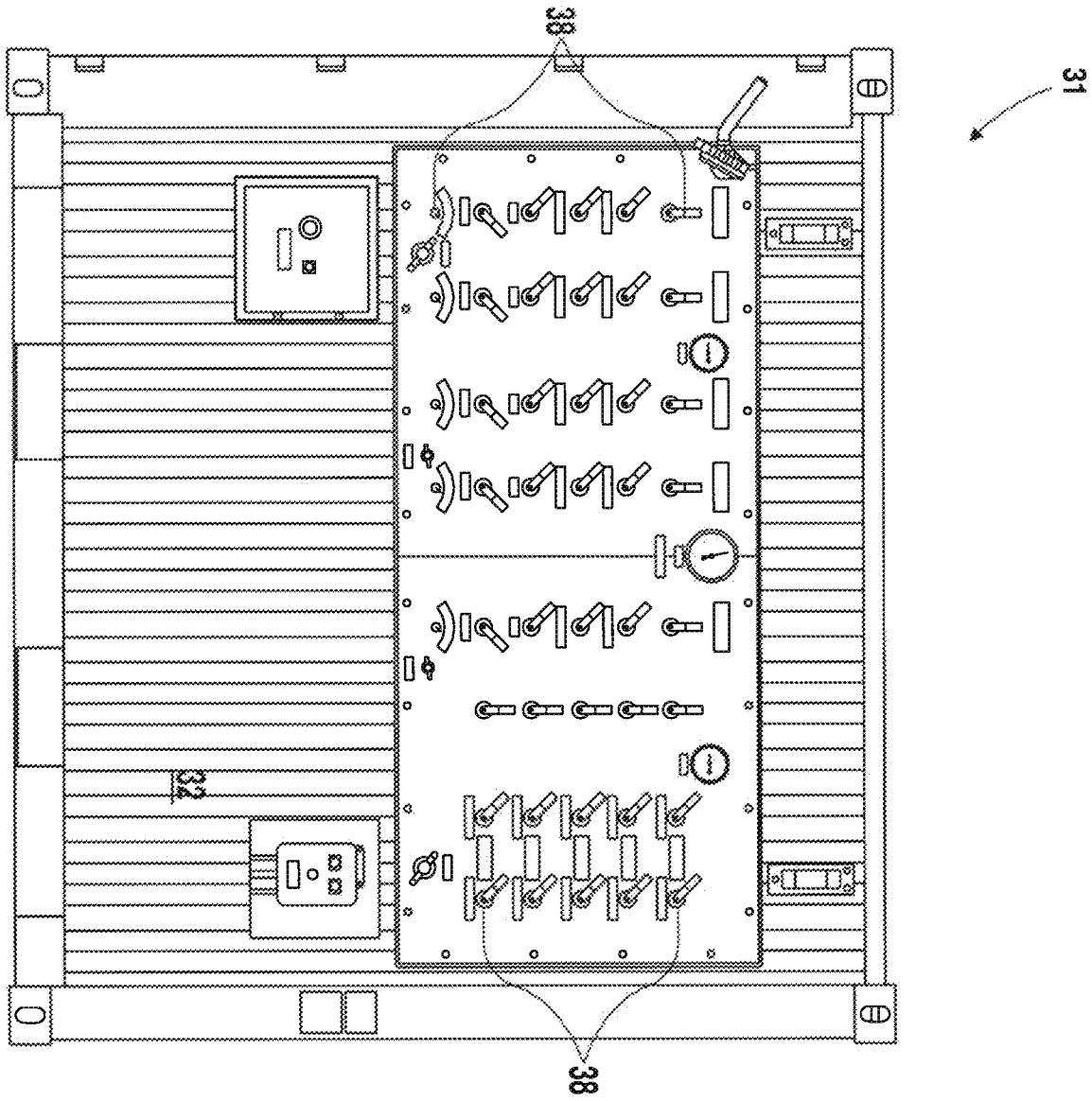
FIG. 6 is a front view of a second embodiment of a main housing of the present invention.

Referring to FIGS. 4 and 5, the control station 54 comprises a user interface 62. In the embodiment shown herein, the user interface 62 comprises a first touch screen 67, a second touch screen 63, a third touch screen 64, and a fourth touch screen 65. Each touch screen 67, 63, 64, 65 corresponds to one of the four wells being controlled by the system 30. Each well being controlled by the system 30 has a dedicated touch screen in the control station 54. The inclusion of well-specific touch screens reduces the potential for human error by sending signals to the wrong well using a singular touch screen or user interface. The inclusion of well-specific touch screens also reduces the time needed to operate the system 30 because the user is not having to navigate a single screen to monitor different wells and/or send instructions to different wells.

The embodiment described herein is shown with four touch screens. However, the invention could be implemented with a different number of screens. A novel aspect of the invention is that the system comprises multiple user interfaces wherein each user interface is dedicated to an individual well and provides the operator with on-premises real-time data about that well. For purposes of this application, real-time data means information that is delivered immediately after collection. For purposes of this application, on-premises data means data that can be generated, transmitted, and displayed without sending the data to a remote network or cloud. Here, the real-time data from the frac tree and well is provided directly to the control station and displayed via the user interface(s).

Referring to FIG. 5, a screen display 68 of a user interface 62 touch screen 67, 63, 64, or 64 is shown. As explained above, the screen display 68 presents data corresponding to one of the wells being controlled by the system 30. The screen display 68 provides the user with real-time on-premise data from the well associated with that screen display 68. The data provided on the screen display 68 includes, but is not limited to flowback data, wireline data, and fracking data. These different types of data are provided simultaneously on the screen at the same time. The user is able to make decisions and adjustments regarding operation of the well without toggling screens or browser windows. The invention described herein allows the operator to efficiently control multiple wells at the same time.

The system 30 comprises a plurality of sensors 69 placed throughout the operation. These sensors 69 collect data 70 about the operation. This data 70 is displayed for the user via the screen display 68. The data 70 collected by the system 30 and displayed via screen display 68 includes, but is not limited to, wireline data, such as depth, line speed, treating PSI, tension, well data, such as well number, state number wireline number, HPU manifold PSI, frac data, such as total proppant, treating PSI, and backside PSI, slurry rate, and close in pressure.

The screen display 68 may further comprise an interactive touch screen diagram 71 of the well and zipper manifold using color coding to signal to the operator(s) which fluid control valves 48 are currently open (green) and which valves 48 are currently closed (light blue with redline). The user can open/close valves by touching the desired valve on the touch screen diagram 71. Security measures can be implemented wherein valves can only be open/closed if a security code or key card is input into the system.

The control station 54 may further provide, store, and/or transmit operational data 72 for the well. The control station 54 may include a pre-programed sequencing of valves 73. The pre-programming of valve sequence creates autonomous capability wherein the system opens and closes valves based on pressure readings detected by the sensors 69.

The control station 54 can be customized to comply with the standard operating procedure 74 of a customer. The control station may include a configuration of frac trees, pressure data for areas of the manifold and wells, and/or operation steps for opening and closing a well.

The control station 54 can also incorporate safety measures 75. The control station 54 can include safety alerts if a wrong valve is wanting to be opened or closed. The control station 54 can include automated adjustments or alerts based on pre-set data readings. In other words, programmable variances would set off pre-programmed alarms. Persons of ordinary skill in the art understand that certain characteristics, also referred to as warning signs, present in the operation may signal the occurrence of a problem. If that problem is not addressed, then significant damage and/or downtime could occur. The system can be programmed to detect one or more of those warning signs and provide an automatic alert. Thus, allowing the problem or defect to be corrected or addressed before causing significant damage or downtime.

For example, the system can be programmed to provide an alert or alarm when a pre-set back side pressure is detected. In one embodiment, the system can be programmed to provide an alert if back side pressure drops below 3500 psi. Alternatively, the system could be programed to provide an alert if the back side pressure reaches a pre-set percentage, such as 75%, of the pumping pressure. The alerts allow the operator to make adjustments necessary to prevent formation damage. The real time creation of alerts based on the observation of pre-programmed data variances is a novel aspect of the invention.

The control station 54 may further comprise operational safety measures such as approval requirements 76 wherein a pin number or other type of key is required to override the planned sequence for opening and closing valves.

The control station 54 may provide the user with additional operational data such as wireline verification, pumping rates, percentage value function, stage count (completed stages and remaining stages), company delegations, flow inside the bore, and wireline, fracking, or flowback status per tree. Persons skilled in the art understand the control panel could include more or less data and/or different types of data, as desired for a particular job site. Suitable computing devices, wiring, power devices, and circuitry are present to operate the control panel and for the control panel to communicate with the other components of the system.

The control station has a small footprint, which is desirable for oilfield equipment. The system can also be programmed to run autonomously, or semi-autonomously, with little or no manual involvement, which is also desirable for oilfield equipment.

The system 30 may further comprise a wireline detection implement 66. In one embodiment, the wireline detection implement comprises a pressure transducer 77 plumbed directly into the tool trap 78. A tool trap is a device that can be opened manually or remotely by hydraulic pressure to allow tool string to be lowered through tool trap from above.

Once a tool string is in position, the tool trap is designed to automatically return to a closed position. The tool trap has a slot that is wider than wireline, but smaller than tool string, thus allowing for un-obstructed wireline travel while in "closed" position. With the tool trap is in the "closed" position, tool string can be raised through the tool trap, when the flared fishing neck of the tool contacts underside of flapper, the flapper is moved up and out of well bore. Once the last component of tool string has passed the flapper, it once again automatically returns to "closed" position. When the pressure reading from the pressure transducer 77 is approximately 15 psi, then the tool trap 78 is open. When the pressure reading from the pressure transducer 77 is less than 15 psi, then the tool trap 78 is closed.

In another embodiment, the wireline detection implement comprises a laser 79. The laser 79 is attached to the back of a tool trap 78 in a manner that does not interfere with operation of the tool trap 78. The laser 79 detects the presence of the tool trap flapper, and sends a signal to the control station that the wireline is out of the well and operation of the valve sequence can begin or continue based on the presence or lack of presence of the flapper.

The system 30 is programmed to not allow the performance of a valve sequence without acknowledgment the tool is in the trap and multiple verifications of personnel. In some embodiments, the system comprises a wireline lube sensor to prevent valve function while tool is in hole.

The system 30 is capable of autonomous, or semi-autonomous, frac sequence operation. In a typically frac operation, the well site operator at each well site has its own valve sequence request or standard operating procedures ("SOP"). For a specific operation, the applicable well site operator's valve sequence or SOP is pre-programmed into the system 30. The system can then run the pre-programmed valve sequence with little or no manual involvement. If the need arises for a variance to the pre-programmed sequence or SOP, then the system 30 will require approval by operations manager(s) or other appropriate supervisor(s) which can be implemented via controls at the control station.

If the operator needs to perform operations that vary from the programmed frac sequence, the system 30 provides for an override of the programmed frac sequence. The variances are programmed for all possible situations and designated to which ones are normal function or require approval.

For maintenance situations wherein valves are not in sequence the system will require a zero out of pressure from the transducers to show there is no operation preventing the maintenance program to allow variances.

For use with a specific operator, the system 30 is programmed with pre-approved SOP 80, agreed upon between the system operator and the well operator. Transducers 81 are placed at key locations in the stack to measure stack data such as pumping pressure, rate times, and/or sudden stops or spikes in pressure. The system may comprise pressure transducers 81 on the bridge, zipper, pump down, and flowback. The system 30 may further comprise valve position percentage sensors 82. The valve position sensors 82 detect whether a valve is open or closed, and send a signal to the control station 54 reporting on the position of the valve.

The control station 54 cross references the stack data from the transducers with a selected pre-approved method. The selected pre-approved method includes data points for the stack data that are deemed acceptable. If the stack data is within the selected pre-approved method, the control unit 54 will permit the frac sequence to begin. If the collected stack data is outside the selected pre-approved method, then an override or adjustment from the operator(s) is necessary. The transducers will continuously collect data at pivotal points (e.g., key locations) of the stack setup and capture data such as pumping pressure, rate times, sudden stops, or spikes of pressure. The collected data is continuously cross referenced with the pre-approved data levels, to ensure the operation of the system 30 is within the pre-approved parameters. For example, the system 30 can be pre-set to approve frac sequence with equalization within five-hundred psi. If the collected data is outside of the five-hundred psi, then the system will not permit frac sequence without an adjustment to the pre-approved thresholds or a credentialed override.

Figure 9:
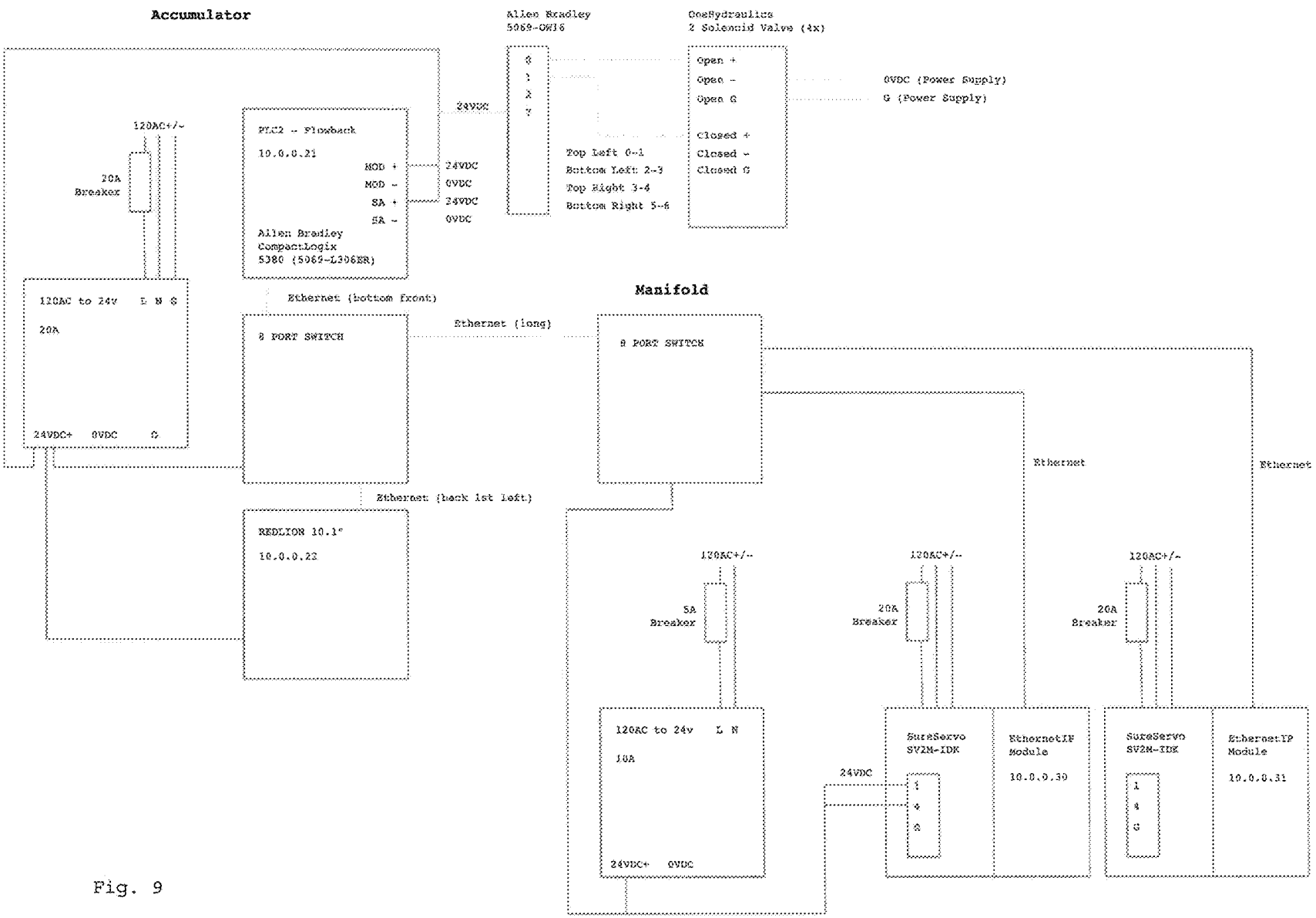
FIG. 9 is a wiring diagram for an embodiment of a flowback monitor of the present invention.
Figure 10:
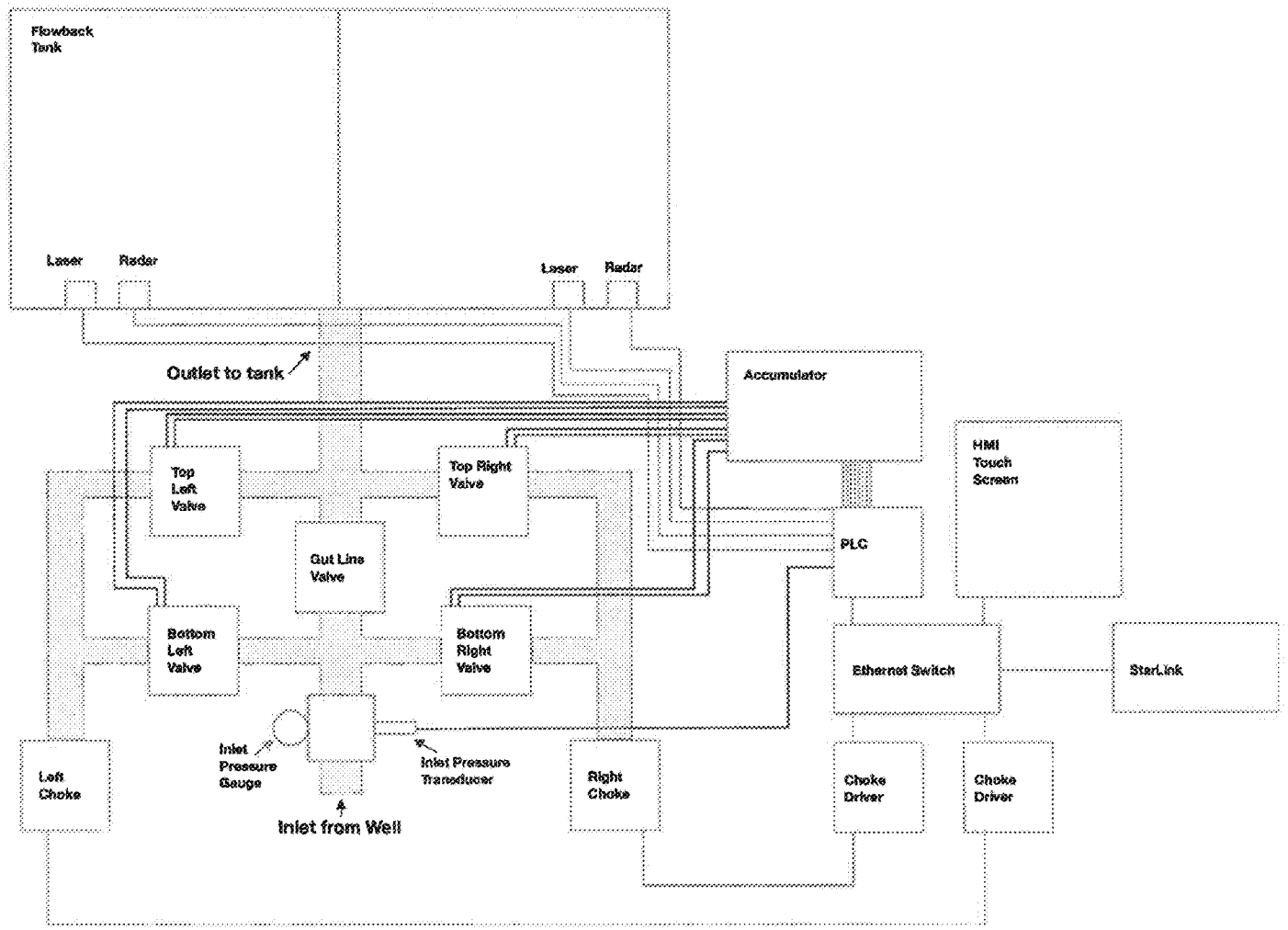
FIG. 10 is a diagram of an embodiment of a flowback monitor of the present invention.

Referring to FIGS. 9-10, the system 30 may further comprise methods and apparatus for the capture, collection, transmission, and display of flowback data. Flowback is a process in the oil and gas industry that occurs after a well has been drilled and hydraulic fracturing (fracking) has been completed. After the fracking process is complete, some of the injected water, sand, and chemicals return to the surface along with the oil and gas. Flowback refers to the process of capturing and managing these fluids and materials as they flow back to the surface.

In one embodiment, the system 30 comprises a first hydraulic upstream valve 83 and a second hydraulic upstream valve 84 and a first automated adjustable choke 85 and a second automated adjustable choke 86. The automated adjustable chokes 85 86 can be set to a desired programmed size. The flowback tank(s) 87 may have a laser sensor 88. The laser sensor 88 measures the fluid level flowback tank(s) 87 and communicates that data to the control center 54. The laser 88 will read real time returns, as well as calibrate itself to adjust when the tanks are emptied. The autonomous flowback system with automated and manual controls described herein prevents a person from needing to climb on the tank to strap start and stop amounts.

The control for the flowback side may be on designated touch screen for choke adjustment and real time returns. The hydraulic switches for the upstream valves will be on their own stand next to the control screens.

The system provides for automated flowback control wherein the return barrels can be set to a desired volume. The system can be programmed to autonomously adjust the flowback by adjusting one or more chokes in response to the laser sensors in the flow tanks. In other words, the system provides the capability to set the return barrels to a desired volume. The electric choke automatically adjusts based on real-time data from multiple sensors on the tank, ensuring optimal flowback performance.

In one embodiment of the flowback systems, the user enters a target PSI and total barrels to flow back using the user interface 68. The user opens left or right side valves using the interactive diagram 71 of the user interface 68. The user instructs the corresponding side choke to start PSI matching via the user interface. The user checks if the inlet PSI is above, below, or within the range of target inlet PSI. If the inlet PSI is below the target PSI, the choke is closed until target PSI is reached. If the inlet PSI is above the target PSI, the choke is opened until target PSI is reached. The system 30 polls fluid level in tank sections, integrates volume changes until the target barrels are hit. The system 30 polls fluid inlet PSI, return choke position if the PSI is outside an error margin of the target PSI. The choke is closed when the target barrels are hit.

While the invention has been described with a certain degree of particularity, it is manifest that many changes may be made in the details of construction and the arrangement of components without departing from the spirit and scope of this disclosure. It is understood the invention is not limited to the embodiments set forth herein for the purposes of exemplification, but is to be limited only by the scope of any future claims, including the full range of equivalency to which each element thereof is entitled.

Further, those skilled in the art understand that computer equipment and network capabilities are necessary to implement the invention without the need to recite all such components

We claim:

1. An apparatus for the remote control of multiple wells comprising:

a first control in communication with a fluid control valve of a first well;

a programmable logic controller;

a control station comprising a first user interface;

the control station, programmable logic controller, and first control are in electronic communication;

the first user interface of the control station comprises a mechanism for sending instructions to the first control to open or close the first fluid control valve of the first well; and the control station is a distance from the first well wherein the control station is outside a redzone surrounding the first well;

a second control in communication with a fluid control valve of a second well;

the control station comprising a second user interface;

the second control is in electronic communication with the programmable logic controller and the control station;

the second user interface comprises a mechanism for sending instructions to the second control to open or close the fluid control valve of the second well; and the control station is a distance from the second well wherein the control station is outside a redzone surrounding the second well;

the first control comprises a plurality of hydraulic controls and the first valve of the first well comprises a plurality of fluid control valves; and the second control comprises a plurality of hydraulic controls and the second fluid control valve of the second well comprises a plurality of fluid control valves;

the first user interface and second user interface are touch screens;

the first user interface comprises an interactive diagram of the first well displaying the fluid control valves of the first well;

the second user interface comprises an interactive diagram of the second well displaying the fluid control valves of the second well;

instructions to open and close the fluid controls valves of the first well can be sent to the first control via the interactive display of the first well; and instructions to open and close the fluid control valves of the second well can be sent to the second control via the interactive display of the second well;

a first set of sensors in communication with the first well and in electronic communication with the programmable logic controller;

a second set of sensors in communication with the second well and in electronic communication with the programmable logic controller;

the first set of sensors capture data from the first well and transmit the data to the programmable logic controller;

the second set of sensors capture data from the second well and transmit the data to the programmable logic controller;

the data captured by the first set of sensors is displayed in real-time via the first user interface; and the data captured by the second set of sensors is displayed in real-time via the second user interface.

2. The apparatus for remote control of multiple wells of claim 1 wherein the data captured by the first and second sets of sensors comprises flowback data, wireline data, and fracking data.

3. The apparatus for remote control of multiple wells of claim 2 further comprising:

a safety alert system comprising an alarm trigger programmed to trigger an alarm when a pre-set alarm triggering scenario is detected.

4. The apparatus for remote control of multiple wells of claim 3 wherein the alarm triggering scenario is a pre-set valve configuration.

5. The apparatus for remote control of multiple wells of claim 3 wherein the alarm trigger scenario is a pre-set pressure reading.

6. The apparatus for remote control of multiple wells of claim 2 further comprising:

an approval system requiring the input of a security key prior to enabling valve opening and valve closing functionality.

7. The apparatus for remote control of multiple wells of claim 6 wherein the security key is a pin number.

8. The apparatus for remote control of multiple wells of claim 1 further comprising: a wireline detection system comprising a transducer plumbed into a tool trap and configured to measure pressure at an opening of the tool trap; the transducer is in electronic communication with the programmable logic controller; when a pressure reading from the transducer is more than a pre-set value, the tool trap is open; and when the pressure reading from the transducer is less than the pre-set value, the tool trap is closed.

9. The apparatus for remote control of multiple wells of claim 1 further comprising: a first pre-programmed valve sequence for the first well comprising data ranges deemed acceptable for the opening a fluid control valve of the first well; data collected via the first set of sensors is cross referenced with the first pre-programmed valve sequence; if the data collected via the first set of sensors is within the data range deemed to be acceptable, the first pre-programed valve sequence is initiated; the apparatus continuously monitors data and continuously cross references the collected data with the first pre-programmed valve sequence; if the collected data deviates from the data range deemed appropriate, an alert is triggered.

10. An apparatus for the remote control of multiple wells comprising:

a main housing comprising a front panel, first side panel, second side panel, back panel, top panel, and bottom panel;

a first set of hydraulic controls mounted to the front panel of the main housing wherein the first set of hydraulic controls are in communication with a set of fluid control valves of a first well;

the set of fluid control valves of the first well comprising well slide fluid control valves and zipper manifold control valves;

the first set of hydraulic controls further comprising a first sub-set of controls and a second sub-set of controls, wherein the first sub-set of controls are in communication with the well side fluid control valves of the first well and the second sub-set of controls are in communication with the zipper manifold fluid control valves of the first well;

a second set of hydraulic controls mounted to the front panel of the main housing wherein the second set of hydraulic controls are in communication with the a set of fluid control valves of a second well;

the second set of hydraulic controls further comprising a first sub-set of controls and a second sub-set of controls, wherein the first sub-set of controls are in communication with a well side fluid control valves of the second well and the second sub-set of controls are in communication with a zipper manifold fluid control valves of the second well;

actuator wings of each hydraulic control protruding through the front panel;

a hydraulic power unit reservoir;

a control valve manifold mounted on the hydraulic power unit reservoir;

a solenoid assembly mounted to the hydraulic power unit reservoir comprising a plurality of solenoids;

each solenoid of the plurality of solenoid connected to a corresponding control and in electronic communication with a programmable logic controller;

a hydraulic accumulator tank;

an electric engine;

a diesel engine;

wherein both the electric engine and the diesel engine are configured to provide power to the apparatus;

a control station housing comprising a control station;

the control station in electronic communication with the programmable logic controller;

the control station comprising a first touch screen user interface corresponding to the first well and a second touch screen interface corresponding to the second well;

the first touch screen user interface comprising an interactive diagram of the fluid control valves of the first well; and the second touch screen user interface comprising an interactive diagram of the fluid control valves of a second well; and the control station is a distance from the first well and the second well wherein the control station is outside of a redzone of the first well and the second well.

* * * * *